US008104303B2

(12) United States Patent
Murata et al.

(10) Patent No.: US 8,104,303 B2
(45) Date of Patent: Jan. 31, 2012

(54) BRANCHING REFRIGERANT RELAY UNIT AND METHOD OF MANUFACTURING THE SAME

(75) Inventors: Katsunori Murata, Kusatsu (JP); Takeshi Kitagawa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 1114 days.

(21) Appl. No.: 11/911,806

(22) PCT Filed: Apr. 12, 2006

(86) PCT No.: PCT/JP2006/307739

§ 371 (c)(1), (2), (4) Date: Oct. 17, 2007

(87) PCT Pub. No.: WO2006/115058

PCT Pub. Date: Nov. 2, 2006

(65) Prior Publication Data

US 2009/0049855 A1 Feb. 26, 2009

(30) Foreign Application Priority Data

Apr. 19, 2005 (JP) ..... 2005-120556

(51) Int. Cl.
*F25D 21/14* (2006.01)

(52) U.S. Cl. ..... 62/290; 62/273; 62/324.5; 29/890.035

(58) Field of Classification Search ..... 29/890.035; 138/149; 62/273, 290, 324.5
See application file for complete search history.

(56) References Cited

U.S. PATENT DOCUMENTS

| | | | | | |
|---|---|---|---|---|---|
| 3,976,110 | A * | 8/1976 | White | 141/346 |
| 4,457,214 | A * | 7/1984 | deVries | 454/255 |
| 4,991,406 | A * | 2/1991 | Fujii et al. | 62/296 |
| 5,090,215 | A * | 2/1992 | Giesler et al. | 62/475 |
| 6,122,926 | A * | 9/2000 | Kang et al. | 62/259.2 |
| 2008/0233332 | A1 * | 9/2008 | Burgess | 428/71 |
| 2010/0147837 | A1 * | 6/2010 | Williams | 220/1.5 |

FOREIGN PATENT DOCUMENTS

| | | |
|---|---|---|
| JP | H4-151466 | 5/1992 |
| JP | H6-137592 | 5/1994 |
| JP | H7-12367 | 1/1995 |
| JP | H8-200748 | 8/1996 |
| JP | H10-238900 | 9/1998 |
| JP | H11-63565 | 3/1999 |
| JP | H11-173604 | 7/1999 |
| JP | 2001-241696 A | 9/2001 |
| JP | 2002-180558 A | 6/2002 |
| JP | 2004-236584 A | 8/2004 |
| JP | 2004-340568 A | 12/2004 |

* cited by examiner

*Primary Examiner* — David Bryant
*Assistant Examiner* — Moshe Wilensky
(74) *Attorney, Agent, or Firm* — Global IP Counselors

(57) ABSTRACT

A branching unit has a refrigerant pipe that is branched into a plurality of branching refrigerant pipes, and includes an insulation material resin casing and an expanded insulation material casing. The insulation material resin casing encloses branching portion while assuring an insulation space between the insulation material resin casing and the branching portion. The expanded insulation material casing is disposed on the external periphery of the insulation material resin casing.

9 Claims, 7 Drawing Sheets

B-B

BRANCHING REFRIGERANT RELAY UNIT AND METHOD OF MANUFACTURING THE SAME

TECHNICAL FIELD

The present invention relates to a branching refrigerant relay unit and a method of manufacturing the same, and particularly relates to a branching refrigerant relay unit in which a refrigerant pipe is branched into a plurality of branching refrigerant pipes and to a method of manufacturing the same.

BACKGROUND ART

In a multi-type air conditioner in which a single outdoor unit and a plurality of indoor units are connected, a refrigerant circuit is formed between an outdoor heat exchanger disposed in the outdoor unit and an indoor heat exchanger disposed in the plurality of indoor units. In this case, branching pipes must be provided to the refrigerant pipe disposed between the outdoor heat exchanger and the indoor heat exchanger in order to transport refrigerant to each of the plurality of indoor heat exchangers.

The branching portion provided to such branching pipes may be provided with a thermistor for detecting the refrigerant temperature, a motor-operated value for adjusting the refrigerant pressure, a vapor-liquid heat exchanger for heat exchange between refrigerants, and electrical parts and other components for controlling the motor-operated value on the basis of the refrigerant temperature detected by the thermistor. The branching portion provided with such branching pipes, thermistor, motor-operated valve, vapor-liquid heat exchanger, and electrical parts and other components is generally accommodated in a casing to constitute a refrigerant relay branching unit.

The branching pipes in the refrigerant relay branching unit have areas in which the temperature is lower than the surrounding temperature because the refrigerant flows into the low pressure pipes, and condensation is liable to form in such a low temperature area.

In contrast, a unit having an insulated structure has been proposed in which the interior of the casing is filled with urethane or another insulation material, as shown in Patent Document 1 described below, in order to prevent such condensation from being generated. In this structure, the insulation material is filled so as to completely encompass the branching pipes, and condensation is avoided by preventing air from coming into contact with the low temperature areas of the branching pipes.

<Patent Document 1> Japanese Laid-open Patent Application No. 10-238900

DISCLOSURE OF THE INVENTION

Problems that the Invention is to Solve

However, in the conventional insulation structure described above, the refrigerant pipe and insulation material tend to adhere to each other because the refrigerant pipe and insulation material are disposed in close proximity to each other. When the refrigerant pipe and the insulation material adhere to each other in this manner, the disassembly work for maintaining the internal components related to the refrigerant pipe, the recycling of the product, and other work becomes laborious. Maintenance cannot be easily performed because the disassembly work is laborious, even in the case that, e.g., maintenance must be performed on the motor-operated valve disposed in the unit.

The present invention was contrived in view of the points described above, and an object of the present invention is to provide a branching refrigerant relay unit that can facilitate disassembly work, and a method of manufacturing the same.

Means of Solving the Problems

The branching refrigerant relay unit of the first aspect of the present invention is a branching refrigerant relay unit in which a refrigerant pipe is branched into a plurality of branching refrigerant pipes, and which comprises a casing and an insulation material. The casing encompasses the branching portion while assuring space between the casing and the branching portion. The insulation material is disposed at the external periphery of the casing.

With the insulation structure used in a conventional branching refrigerant relay unit, the refrigerant pipe and insulation material are disposed in close proximity to each other. For this reason, there are cases in which the refrigerant pipe and the insulation material adhere to each other, and disassembly work is laborious when maintenance or the like is performed on the motor-operated valve or other components related to the refrigerant pipe.

In contrast, with the branching refrigerant relay unit of the first aspect of the present invention, the branching portion of the refrigerant pipe is encompassed by a casing with a gap provided therebetween. For this reason, the branching portion of the refrigerant pipe never makes direct contact with the casing and the insulation material. The insulation material is disposed at the external periphery of the casing. The insulation properties of the branching portion of the refrigerant pipe are thereby assured by the insulation material and the space secured between the insulation material and the casing. Adhesion of the casing or the insulation material to the branching portion of the refrigerant pipe can therefore be avoided, and the branching portion can be easily disassembled from the casing and the insulation material.

Therefore, the work of disassembling the branching refrigerant relay unit can be facilitated while assuring the insulation properties in the branching portion of the refrigerant pipe.

Branching pipes have a portion in which the temperature is reduced below the surrounding temperature by the flow of the refrigerant through the low-pressure pipes, and condensation readily occurs in such low-temperature portions. In the branching refrigerant relay unit described above, however, the disassembly work can be simplified while reducing condensation by assuring insulation properties and assuring airtightness in the refrigerant circuit that includes the motor-operated valve.

The branching refrigerant relay unit according to the second aspect of the present invention is the branching refrigerant relay unit according to the first aspect, and the casing has a first casing and a second casing as a pair that have corresponding mating portions that mate with each other. Also, the insulation material has a first insulation material configured to be integral with the first casing, and a second insulation material configured to be integral with the second casing.

Here, the first casing and the first insulation material are integrally assembled, and the second casing and the second insulation material are integrally assembled, thereby forming two structural bodies. The two structural bodies are merely separated or brought together to thereby allow the assembly to be easily disassembled or assembled.

When the above-described two structural bodies are, for example, in a vertically divided structure with respect to the surface on which the branching refrigerant pipes are aligned, the disassembly and assembly of the branching refrigerant relay unit can be further facilitated.

The branching refrigerant relay unit according to the third aspect of the present invention is the branching refrigerant relay unit according to the second aspect, and part of the mating portion of the first casing is a concave shape. Also, part of the mating portion of the second casing is a convex shape that fits into the concave shape.

In this case, the mating portion of the first casing is a concave shape, and the mating portion of the second casing is a convex shape. With the branching refrigerant relay unit according to the third aspect, a mating structure having mating concave shapes (grooves) and convex shapes (projections) is used in which the concave and convex shapes fit each other. For this reason, the movement of the first and second casings is restricted in the direction perpendicular to the concavo-convex direction.

Therefore, the seal characteristics between the first and second casings can be improved by the mating structures produced by the concave and convex shapes.

The mating structures described above are not limited to the casings. For example, the mating portion of the first casing and the corresponding portion of the first insulation material may be a concave shape such as grooves, and the mating portion of the second casing and the corresponding portion of the second insulation material may be a convex shape such as projections that fit into the concave shape. In this case, the movement of the first casing and first insulation material, and the second casing and second insulation material is restricted in the direction facing the direction that is perpendicular to the concavo-convex direction. Thus, the seal characteristics between the first casing and first insulation material, and the second casing and second insulation material can be improved by the mating structures produced by the concave and convex shapes.

The branching refrigerant relay unit according to the fourth aspect of the present invention is the branching refrigerant relay unit according to any of the first through third aspects, and further comprises a metal casing for covering the external periphery of the insulation material.

In this case, the branching portion of the refrigerant pipe is limited so as to reduce the amount of heat produced. Also, in the case of an unexpected emergency situation, fire can be effectively prevented from spreading because the casing that covers the external periphery of the insulation material is made of metal.

The branching refrigerant relay unit has a metal casing-covered structure, and the strength of the branching refrigerant relay unit overall can therefore be improved even if the insulation material is a soft material, for example.

The branching refrigerant relay unit according to the fifth aspect of the present invention is the branching refrigerant relay unit according to any of the first through fourth aspects, and the casing contains an injection-molded resin.

In this case, an injection-molded resin, which is curable resin, is contained as the material of the casing disposed inside the branching refrigerant relay unit. For this reason, the seal characteristics between the first and second casings can be more effectively improved.

The branching refrigerant relay unit according to the sixth aspect of the present invention is the branching refrigerant relay unit according to any of the first through fifth aspects, and the insulation material contains at least one material selected from PS, EPS, PP, and EPP. In this case, PS refers to polystyrene, and EPS refers to expanded polystyrene, i.e., styrene foam.

A conventional insulation structure is constructed by causing urethane to expand. However, the method of causing urethane to expand has the following problems. In other words, since the temperature increases (about 100° C.) due to the foaming heat, there is a need such as to dispose or otherwise position functional components disposed in the vicinity of the branching portion, temperature sensors, and the like outside of the foaming space in order to be protected from the foaming heat.

In contrast, the branching refrigerant relay unit of the sixth aspect is obtained using pre-molded components in which the insulation material contains at least one material selected from PS, EPS, PP, and EPP. For this reason, molded components obtained by foaming any of PS, EPS, PP, and EPP and dissipating the foaming heat can be used when the branching refrigerant relay unit is manufactured. It is therefore possible to solve the problem of the effect of foaming heat on temperature sensors and functional components disposed in the vicinity of the branching portion.

The branching refrigerant relay unit according to the seventh aspect of the present invention is the branching refrigerant relay unit according to any of the first through sixth aspects, and the casing has through portion for allowing a pipe that extends from the branching portion to pass through, and a surrounding portion that surrounds the through portion from a direction perpendicular to the through direction. The through portion contains rubber, and the external periphery thereof is molded so as to have a shape that corresponds to the surrounding portion.

In this case, the through portion is formed so that the external periphery thereof is shaped to correspond to the surrounding portion. For this reason, the shape of the through portion can be stabilized in a constant shape and the seal properties between the through portion and the surrounding portion can be improved. Also, since the through portion contains rubber and is molded, the through portion has elasticity in the direction enclosed by the surrounding portion. Therefore, the seal properties between the through portion and the surrounding portion can be further improved via a synergistic effect between the elasticity and the stabilized shape of the through portion.

The method for manufacturing a branching refrigerant relay unit according to the eighth aspect of the present invention is a method of manufacturing a branching refrigerant relay unit in which a refrigerant pipe is branched into a plurality of branching refrigerant pipes, and which comprises the following three steps. In the first step, a casing is formed so as to enclose the branching portion while assuring a space between the casing and the branching portion. In the second step, the casing is enclosed using an insulation material molded in advance so as to follow the external periphery of the casing. In the third step, the insulation material is enclosed using a metal casing.

With a conventional method of manufacturing a branching refrigerant relay unit, the refrigerant pipe and the insulation material are disposed in close proximity to each other in an insulation structure that is built in accordance with manufacturing processes. For this reason, the refrigerant pipe and the insulation material are liable to adhere to each other, and disassembly work is laborious when maintenance or the like is performed on the motor-operated valve or other components related to the refrigerant pipe.

In contrast, with the method of manufacturing a branching refrigerant relay unit of the eighth aspect, a branching refrigerant relay unit is manufactured by enclosing the branching portion in a casing while assuring a space about the periphery, enclosing the casing using an insulation material molded in advance, and enclosing the insulation material using a metal casing.

Therefore, the branching portion of the refrigerant pipe is enclosed by a casing with a space provided, and the branching portion of the refrigerant pipe does not make direct contact with the casing and the insulation material. The insulation material is disposed about the external periphery of the casing. The insulation properties of the branching portion of the refrigerant pipe are thereby assured by the insulation material and the space maintained between the casing and the pipes. For this reason, the casing and the insulation material can be prevented from adhering to the branching portion of the refrigerant pipe, and disassembly of the casing and insulation material from the branching portion can be facilitated. Therefore, a branching refrigerant relay unit that allows disassembly work to be facilitated can be manufactured while assuring the insulation properties in the branching portion of the refrigerant pipe.

Furthermore, in this case, an insulation material that has been molded and cooled in advance is used. For this reason, even in cases in which a branching refrigerant relay unit is manufactured in which the branching portions of the refrigerant pipe include components having a low resistance to heat, heat-induced damage to these components can be avoided.

Effect of the Invention

With the branching refrigerant relay unit according to the first aspect of the present invention, the work of disassembling the branching refrigerant relay unit can be facilitated while assuring the insulation properties in the branching portion of the refrigerant pipe.

With the branching refrigerant relay unit according to the second aspect of the present invention, the two structural bodies are merely separated or brought together to thereby allow the assembly to be easily disassembled or assembled.

With the branching refrigerant relay unit according to the third aspect of the present invention, the seal properties between the first and second casings can be improved by using a mating structure produced by concave and convex shapes.

With the branching refrigerant relay unit according to the fourth aspect of the present invention, in the case of an unexpected emergency situation, fire can be effectively prevented from spreading because the casing that covers the external periphery of the insulation material is made of metal.

With the branching refrigerant relay unit according to the fifth aspect of the present invention, the seal properties between the first and second casings can be effectively improved.

With the branching refrigerant relay unit according to the sixth aspect of the present invention, it is possible to solve the problem of the effect of foaming heat on temperature sensors and functional components disposed in the vicinity of the branching portion.

With the branching refrigerant relay unit according to the seventh aspect of the present invention, the seal properties between the through portion and the surrounding portion can be further improved via a synergistic effect between the elasticity and the stabilized shape of the through portion.

With the method of manufacturing a branching refrigerant relay unit according to the eighth aspect of the present invention, even in cases in which a branching refrigerant relay unit is manufactured in which the branching portions of the refrigerant pipe include components having a low resistance to heat, heat-induced damage to these components can be avoided.

KEY

Figure 1:
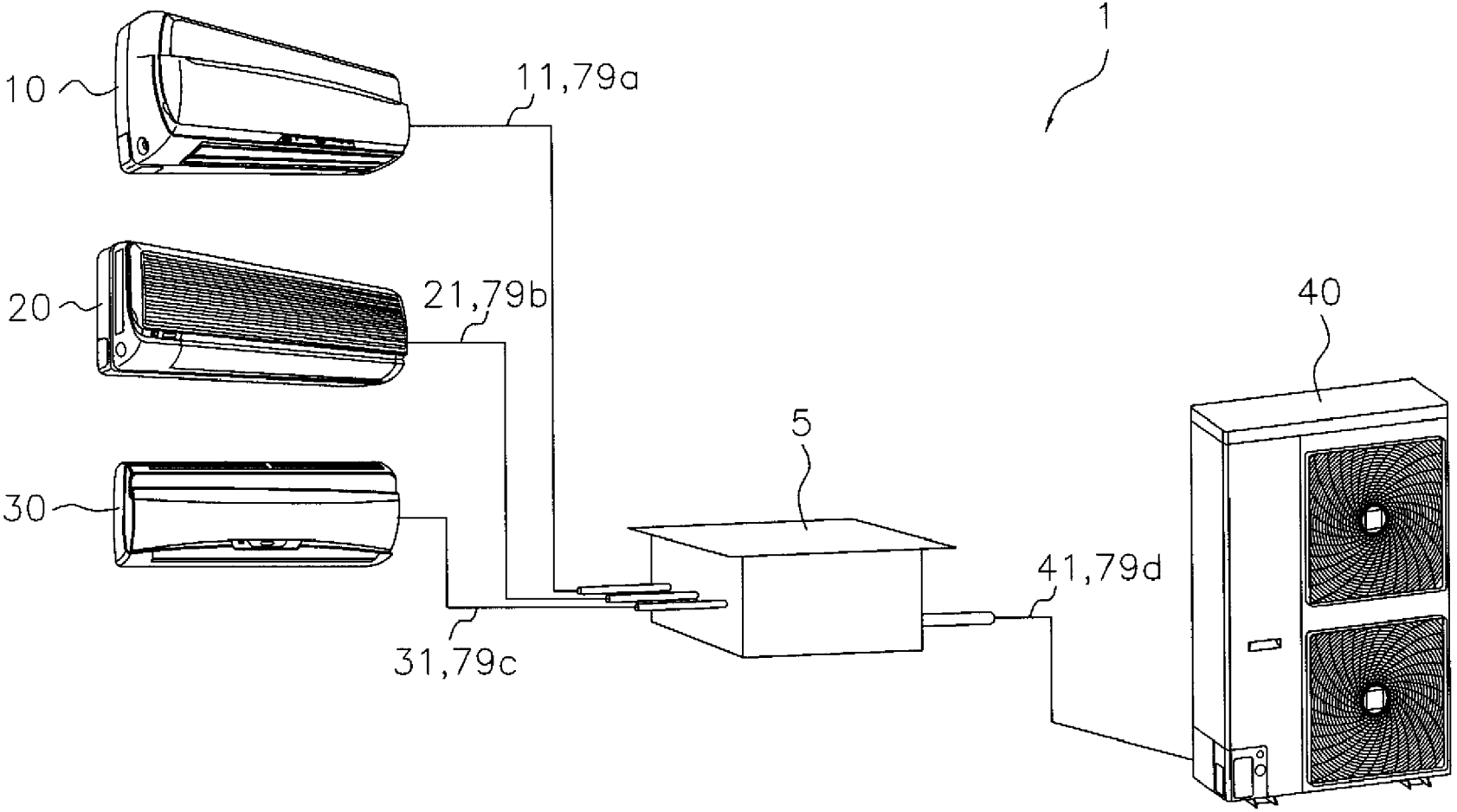
FIG. 1 is a perspective view showing the overall configuration of the external appearance of an air conditioner in which the first embodiment of the present invention is used.

5 Branching unit (branching refrigerant relay unit)
11, 21, 31 Branching refrigerant pipes
41 Refrigerant pipe
50 Main body (main unit)
50S Insulating space (space)
51 Insulation material resin casing (casing)
52 Upper resin casing (first casing, surrounding portion)
53 Lower resin casing (second casing, surrounding portion)
54 Expanded insulation material casing (insulation material)
55 Upper insulation material casing (first insulation material)
56 Lower insulation material casing (second insulation material)
57 Plate metal casing (metallic casing)
57*a* Upper plate metal casing
57*b* Lower plate metal casing
61, 62, 63, 64 Rubber bushing (through portion)
88 Branching portion
88*a* Branching pipe (branching portion)
88*b* Vapor-liquid heat exchange unit (branching portion)

BEST MODE FOR CARRYING OUT THE INVENTION

<Outline of the Invention>

In the present invention, a branching refrigerant relay unit is provided in which a refrigerant pipe is branched into a plurality of branching refrigerant pipes. With the branching refrigerant relay unit of the present invention, a structure is used in which the branching portion is covered by the casing by providing an insulative space between the casing and the branching portion, and the external periphery of the casing is covered using insulation material. This approach is adopted instead of maintaining insulation properties by directly covering the branching portion of the refrigerant pipe using insulation material. The branching refrigerant relay unit is thereby characterized in that airtightness is assured in the branching portion of the refrigerant circuit that includes a motor-operated valve, insulation properties are assured while reducing condensation, and disassembly work is facilitated. Recycling the respective components can thereby be facilitated, and assembly after disassembly can be improved.

The branching refrigerant relay unit (branching unit 5) of the present invention will be described in detail below as applied to an air conditioner.

<Configuration Outline of an Air Conditioner>

The configuration outline of an air conditioner that includes a branching unit 5 will be described with reference to FIG. 1 as an example of the refrigerant relay branching unit of the present invention.

The air conditioner 1 comprises a single outdoor unit 40 and a plurality of indoor units 10, 20, and 30.

The outdoor unit 40 houses an outdoor heat exchanger, a compressor, an accumulator, a four-way switching valve, other portions of the refrigerant circuit, a propeller fan that generates an air current for carrying out heat exchange between outside air and the refrigerant inside the outdoor heat exchanger, a fan motor for driving the propeller fan, a thermistor for detecting the temperature of the refrigerant in the outdoor heat exchanger, control circuit for controlling the apparatus, and other components.

The indoor units 10, 20, and 30 each have an indoor heat exchanger, a temperature sensor for detecting the indoor temperature, a cross-flow fan that generates an air current for carrying out heat exchange between the indoor air and the indoor heat exchanger, a fan motor for driving the cross-flow fan, a control circuit that communicates with the outdoor unit 40 and controls the fan motor, and other components.

The outdoor heat exchanger inside the outdoor unit 40 and the indoor heat exchangers inside the indoor units 10, 20, and 30 are connected via a refrigerant pipe 41 and branching refrigerant pipes 11, 21, and 31, and are provided with a branching unit 5 for branching the pipes from the refrigerant pipe 41 of the outdoor unit 40 side to the branching refrigerant pipes 11, 21, and 31 of the indoor unit side.

<Outline of the Branching Unit>

Figure 2:
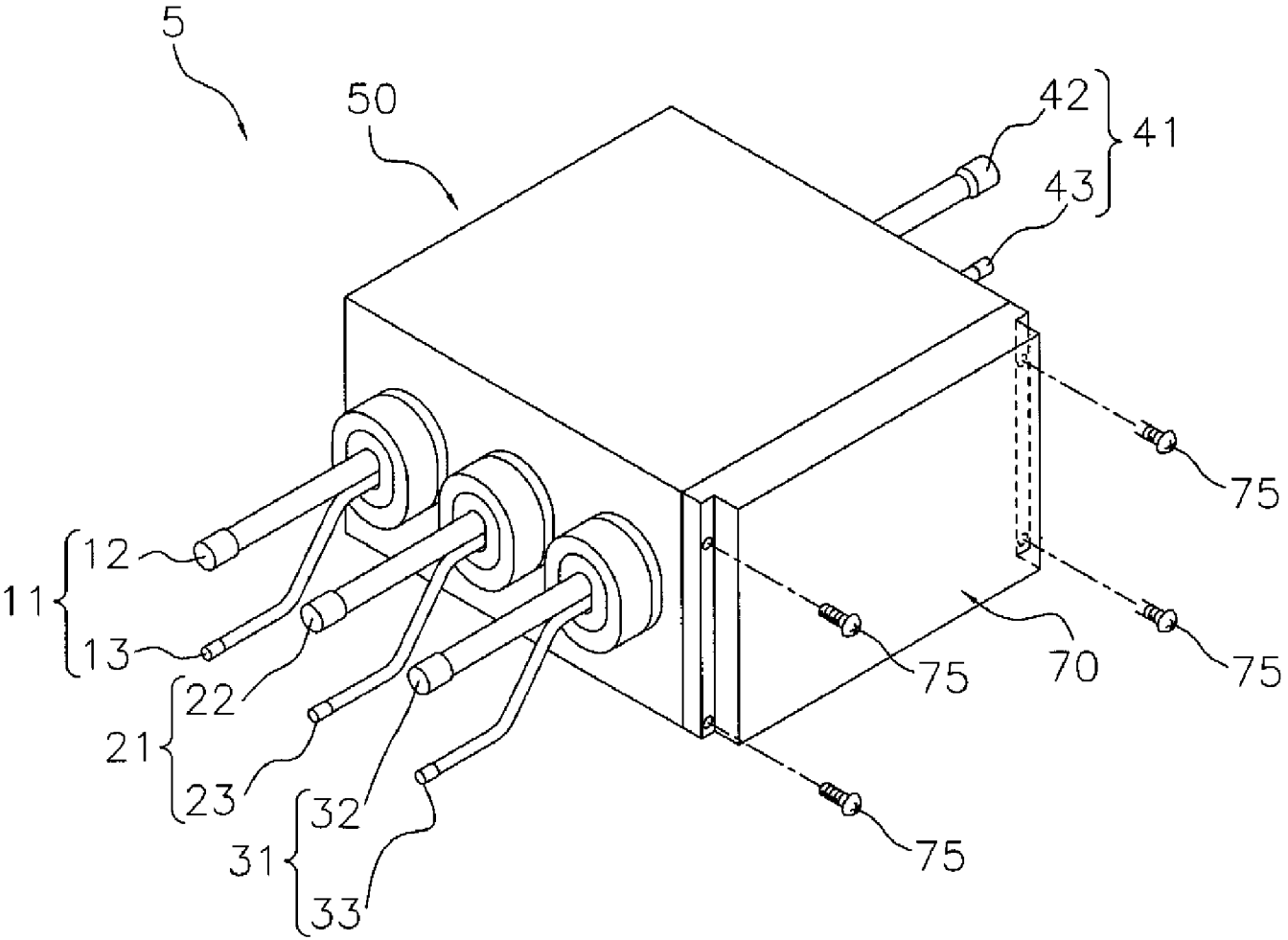
FIG. 2 is a perspective view of the external appearance of the branching unit.

FIG. 2 shows an outline configuration of the branching unit 5.

The branching unit 5 is composed of a main body 50 and an electric component box 70 that is mounted in the main body 50 and controls the electrical components inside the main body 50.

A refrigerant circuit having a VRV control system (variable refrigerant volume control system) is mounted in the branching unit 5. A refrigerant circuit in which such a VRV control system is used allows a refrigerant circuit to be composed of a single outdoor unit 40 and a plurality of indoor units 10, 20, and 30 (see FIG. 1).

The branching unit 5 is composed of a main body 50, an electric component box 70, a refrigerant pipe 41, branching refrigerant pipes 11, 21, and 31, and other components.

The electric component box 70 provided with a board 71 (described later) for controlling each device is threadably attached to the main body 50 using a screw 75.

Among the pipes housed in the main body 50, the refrigerant pipe 41 is a pipe that extends from the outdoor unit 40 and is composed of a gas pipe 42 and a liquid pipe 43, as shown in FIGS. 1 and 2.

The branching refrigerant pipes 11, 21, and 31 are pipes that extend from each of the indoor units 10, 20, and 30 from among the pipes housed in the main body 50, and are composed of gas pipes 12, 22, and 32 and liquid pipes 13, 23, and 33, respectively, as shown in FIGS. 1 and 2. The branching refrigerant pipes 11, 21, and 31 are arrayed in the horizontal direction with respect to the installation of the branching unit 5. The branching unit 5, which houses the branching refrigerant pipes 11, 21, and 31, can thereby be provided with a structure that is easily separated in the vertical direction.

The branching unit 5 is disposed above the ceiling or in another indoor location so that the distance (length of the pipes) between the indoor units 10, 20, and 30 is made as short as possible from the standpoint of maximizing the efficiency of the refrigerant capacity and making the installation as simple as possible in a building in which a plurality of indoor units 10, 20, and 30 are installed. In this case, the branching unit 5 is sometimes placed near the bathing room or near water, and the branching unit 5 must be highly airtight. Since the installation location is often a narrow location, the ease of disassembly during maintenance is also required. For this reason, a highly airtight insulation structure is adopted and a structure that assures easy disassembly is used in the branching unit 5.

The internal structure of the branching unit 5 in which a highly airtight insulation structure is used and ease of disassembly is assured will be described below.

<Internal Structure of the Branching Unit 5>

Figure 3:
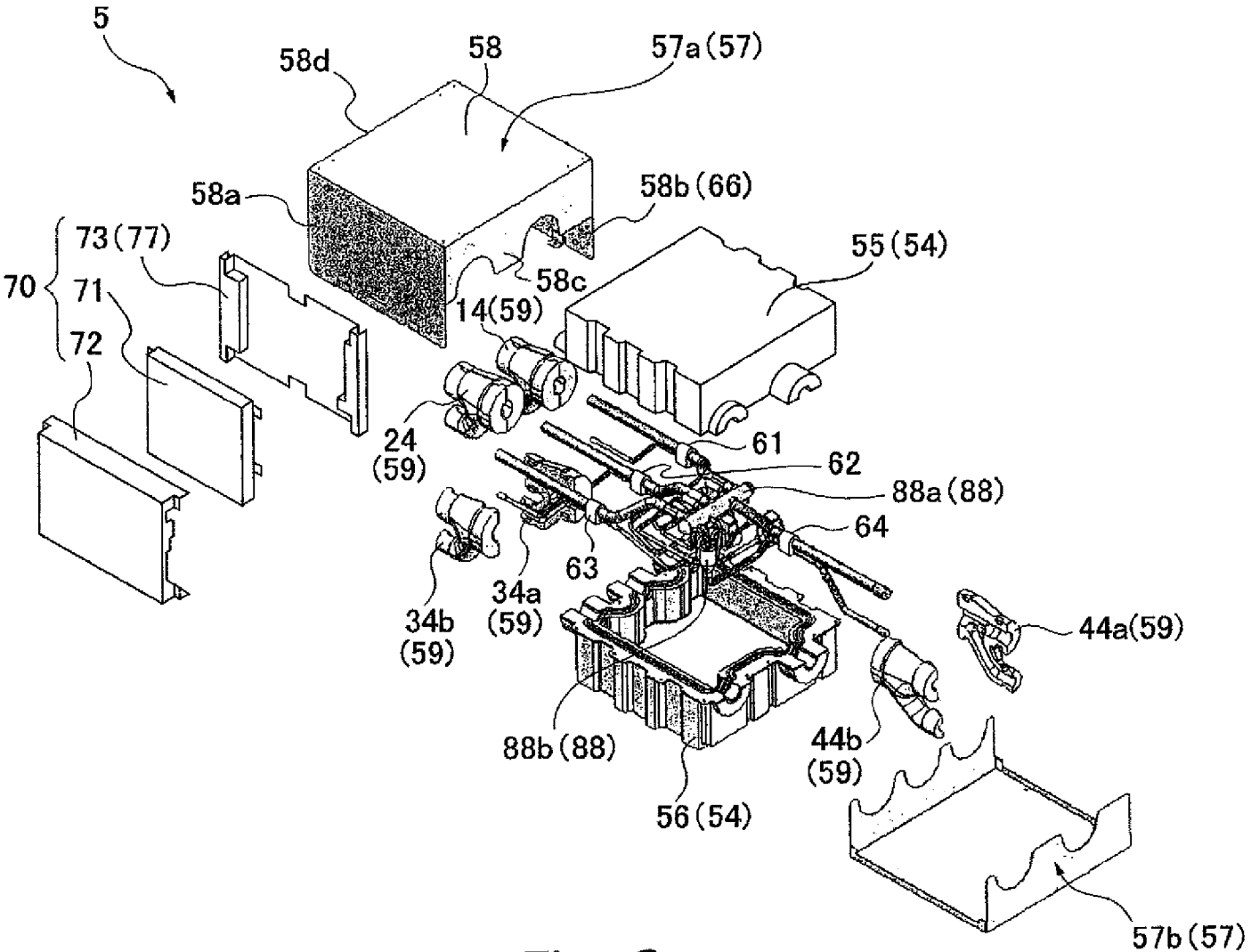
FIG. 3 is an exploded perspective view of the branching unit.
Figure 4:
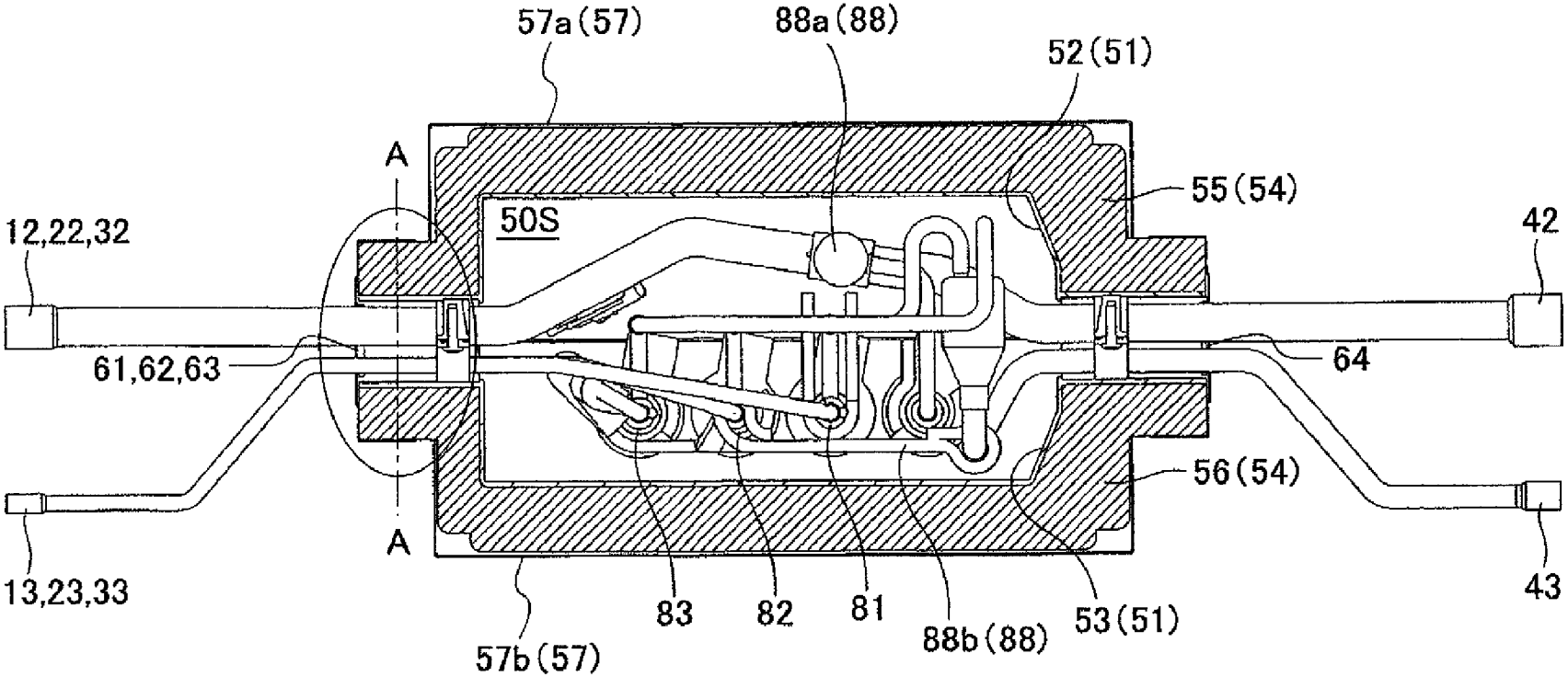
FIG. 4 is a cross-sectional view showing the insulation structure.

FIG. 3 is an exploded perspective view of the branching unit 5, and FIG. 4 shows a cross section showing the insulation structure of the branching unit 5.

The branching unit 5 is composed of a main body 50, an electric component box 70, a refrigerant pipe 41, branching refrigerant pipes 11, 21, and 31, a branching portion 88, and other components, as described above.

The branching portion 88 is a portion in which the refrigerant pipe 41 is branched into three branching refrigerant pipes 11, 21, and 31, and are composed of a branched pipe 88*a* and a vapor-liquid heat exchange unit 88*b*. The branched pipe 88*a* is used to branch off and connect the gas pipe 42 of the outdoor unit 40 side to a plurality of gas pipes 12, 22, and 32 of the indoor units 10, 20, and 30 sides. The vapor-liquid heat exchange unit 88*b* is used to branch off and connect the liquid pipe 43 of the outdoor unit 40 side to the liquid pipes 13, 23, and 33 of the indoor units 10, 20, and 30 sides. The vapor-liquid heat exchange unit 88*b* is used for carrying out heat exchange between high-temperature refrigerant liquid and low-temperature refrigerant gas, and is provided with a refrigerant circuit (not shown) for reintroducing refrigerant to this vapor-liquid heat exchange unit 88*b*. Motor-operated valves 81, 82, and 83 are disposed in the refrigerant circuit in closer proximity to the indoor units 10, 20, and 30 than to the vapor-liquid heat exchange unit 88*b* so as to reduce pressure during cooling and to distribute refrigerant during heating. The motor-operated valves 81, 82, and 83 each have expansion valves and control the opening degree of the valve in each expansion valve, whereby the amount by which the pressure of the refrigerant is reduced can be adjusted and the amount of refrigerant that passes through the pipes can be controlled.

A gas pipe thermistor (not shown) for performing isothermal control during cooling and detecting the internal temperature of the refrigerant in order to prevent condensation on the pipes is disposed in the gas pipes 12, 22, and 32 of the indoor units sides in the vicinity of the branching portion 88. A liquid pipe thermistor (not shown) for performing isothermal control during heating and detecting the internal temperature of the refrigerant is disposed in the liquid pipes 13, 23, and 33 of the indoor unit side.

The gas pipe 42 and liquid pipe 43 constituting the refrigerant pipe 41 are configured so that an outdoor unit separation area is formed in which the distance between these pipes increases in the vertical direction as the distance from the interior of the main body 50 toward the outdoor unit 40 increases. Also, a rubber bushing 64 that encloses the gas pipe 42 and the liquid pipe 43 so as to bring the pipes together is provided between the branching portion 88 and the outdoor unit separation area.

The gas pipes 12, 22, and 32 and the liquid pipes 13, 23, and 33 that constitute the branching refrigerant pipes 11, 21, and 31 are configured so that an indoor unit separation area is formed in which the distance between these pipes increases in the vertical direction with increased distance from the interior of the main body 50 toward the indoor units 10, 20, and 30. Also, rubber bushings 61, 62, and 63 that enclose the gas pipes 12, 22, and 32 and the liquid pipes 13, 23, and 33 so as to bring the pipes together are provided between the branching portions 88 and the indoor unit separation area.

(Structure of the Main Body 50)

The main body 50 is composed of an insulation material resin casing 51, an expanded insulation material casing 54, a plate metal casing 57, and a pipe receiving portion 59, as shown in FIGS. 3 and 4.

The insulation material resin casing 51 is composed of an upper resin casing 52 positioned on the upper side with respect to the surface on which the branching refrigerant pipes are provided, and a lower resin casing 53 positioned on the lower side, as shown in FIG. 4. The upper resin casing 52 and lower resin casing 53 are molded from an injection-molded resin having excellent fire-inhibiting properties. The upper resin casing 52 and lower resin casing 53 are brought together in the vertical direction to form a rectangular parallelepiped casing so that the branching portion 88, a portion of the refrigerant pipe 41, and a portion of the branching refrigerant pipes 11, 21, and 31 are accommodated inside. An insulation space 50S is provided between the insulation material resin casing 51, the portion of refrigerant pipe 41, the portion of the branching refrigerant pipes 11, 21, and 31, and the branching portion 88 so that these components do not make contact with each other, as shown in FIG. 4. The upper resin casing 52 and lower resin casing 53 are placed in contact with each other while sandwiching the rubber bushings 61, 62, 63, and 64 disposed integrally with the gas pipe and liquid pipe described above, as shown in FIG. 3.

The expanded insulation material casing 54 is disposed so as to be in contact with the external periphery of the insulation material resin casing 51, as shown in FIG. 4, and is composed of an upper insulation material casing 55 disposed so as to be in contact with the upper side of the upper resin casing 52, and a lower insulation material casing 56 disposed so as to be in contact with the lower side of the lower resin casing 53. The upper insulation material casing 55 and the lower insulation material casing 56 are formed from EPS (expanded polystyrene, i.e., styrene foam), which is a styrene-based resin having excellent insulation properties. In this case, the amount of moisture that is absorbed via exposure to air can be reduced because a styrene-based resin is used rather than a urethane-based resin. The upper insulation material casing 55 together with the upper resin casing 52 described above, and the lower insulation material casing 56 together with the lower resin casing 53 described above are brought into contact with each other in the vertical direction via the insulation material resin casing 51.

Figure 5:
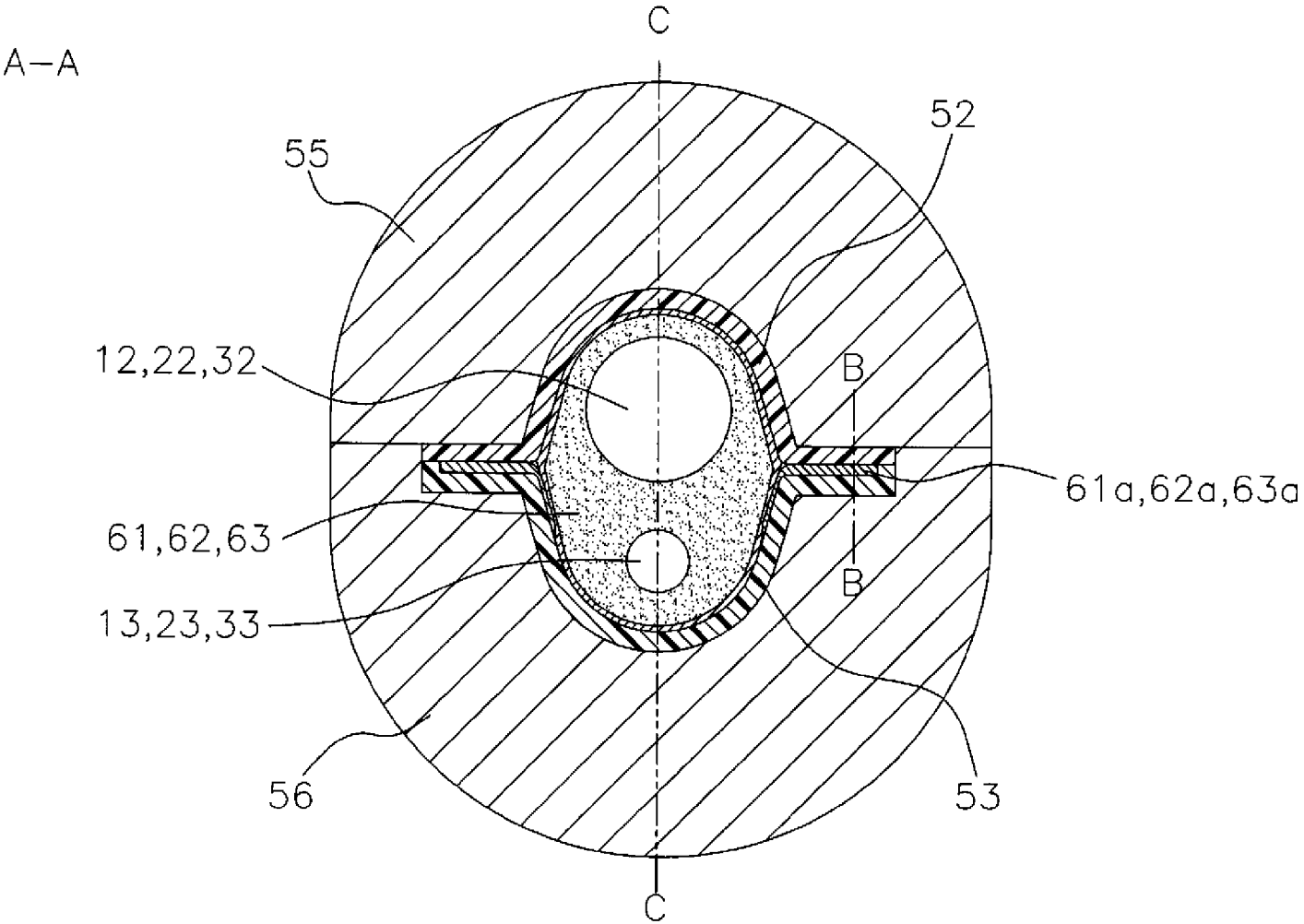
FIG. 5 is a cross-sectional view of the cross-section A-A of the branching unit.

FIG. 5 shows in detail the cross section A-A in FIG. 4.

As described above, the upper resin casing 52 and the upper insulation material casing 55, and the lower resin casing 53 and the lower insulation material casing 56 are placed in contact with each other while sandwiching the rubber bushings 61, 62, and 63, as shown in FIG. 3. For this reason, the insulation material resin casing 51 on the side facing the indoor units 10, 20, and 30 has depressions formed for inserting the rubber bushings 61, 62, and 63. Although not depicted, the same applies to the side facing the outdoor unit 40, as described below.

In this case, seal materials 61*a*, 62*a*, and 63*a* are placed between the insulation material resin casing 51 and the rubber bushings 61, 62, and 63.

The seal materials 61*a*, 62*a*, and 63*a* are formed from EPDM, but it is also possible to use sponge or another synthetic resin material. The airtightness in the area of contact between the rubber bushings 61, 62, and 63, and the upper resin casing 52 and lower resin casing 53 is further improved by the seal materials 61*a*, 62*a*, and 63*a*. The insulation material resin casing 51 may be considered a partition member separating the expanded insulation material casing 54 and the branching portion 88 while assuring space between the partition member and the branching portion 88. The partition member is formed of at least the upper resin casing 52 and the lower resin casing 53, but the rubber bushings 61, 62, 63, and 64 and the seal materials 61*a*, 62*a*, and 63*a* or any combination thereof may also be parts of the partition member.

Figure 6:
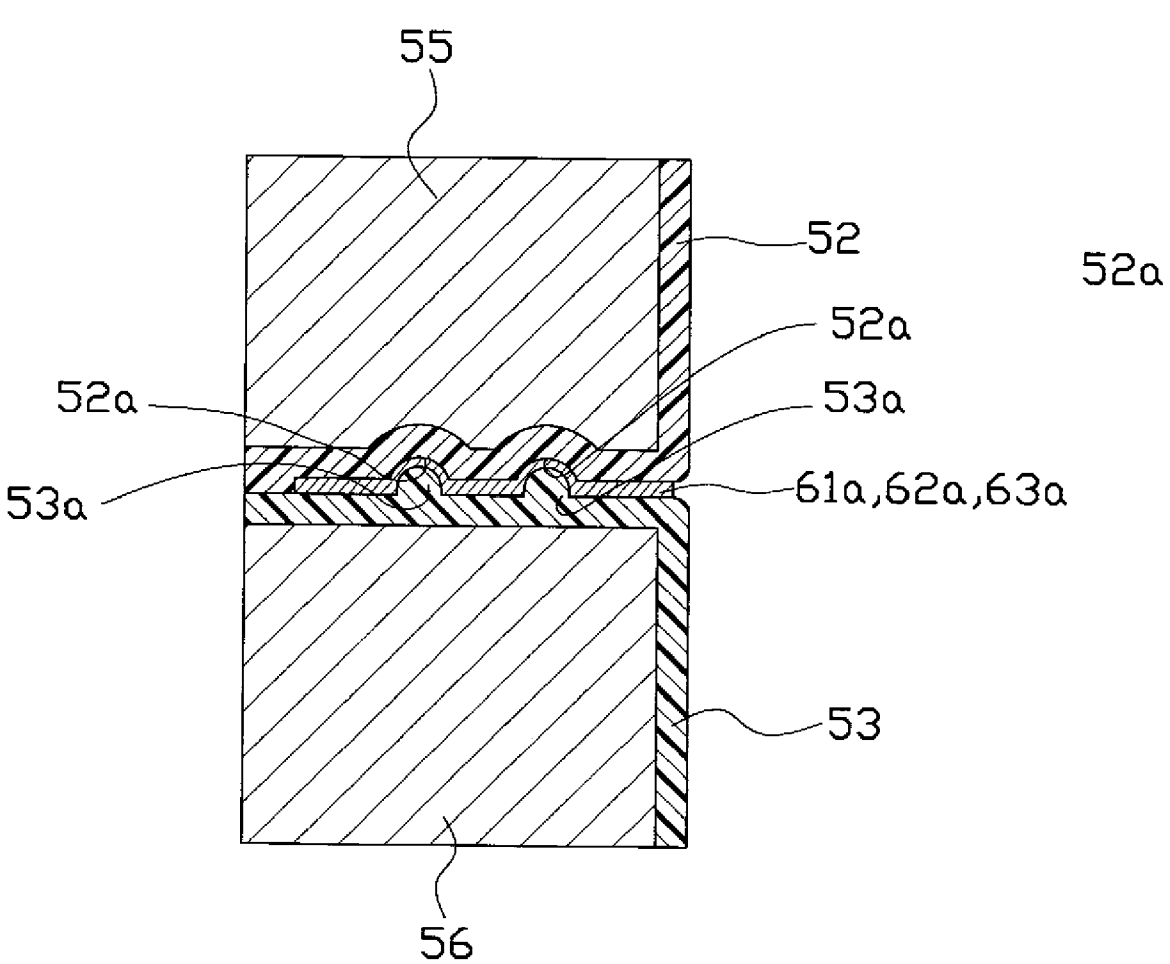
FIG. 6 is a cross-sectional view of the cross-section B-B of the branching unit.

FIG. 6 shows the cross section B-B (cross section of the direction in which the branching refrigerant pipes extend) in detail in FIG. 5.

In this case, the lower resin casing 53 has convex shapes that project in the upward direction in the area in which the lower resin casing 53 and upper resin casing 52 make contact via the seal materials 61*a*, 62*a*, and 63*a*. The upper resin casing 52 has corresponding concave shapes so as to receive the convex shapes of the lower resin casing 53. The convex shapes of the lower resin casing 53 are continuously formed along the entire contact area, as shown in FIG. 3. The corresponding upper resin casing 52 also has concave shapes continuously formed in the entire contact area.

A mating structure in which the concavo-convex shapes correspond to each other is formed, and the insulation material resin casing 51, which is a hard resin, sandwiches the rubber bushings 61, 62, and 63 via the seal materials 61*a*, 62*a*, and 63*a*, whereby the movement of the upper resin casing 52 and the lower resin casing 53 is reduced in the direction in which the pipes extend, and the sealing properties between the upper resin casing 52 and lower resin casing 53 are improved.

In accordance with the structure described above, the seal materials 61*a*, 62*a*, and 63*a* are formed from elastic EPDM, and the rubber bushings 61, 62, 63, and 64 are also formed from elastic rubber. Therefore, airtightness is not compromised even during expansion and contraction that accompanies rising and falling outside temperatures. Airtightness can been better maintained at a high level, and condensation based on the difference between the temperature of the outside air and the temperature of the refrigerant in the internally-disposed pipes can be greatly reduced because of the wrapped structure produced by the sealing material and the concavo-convex-shaped grooved structure.

In accordance with the insulation structure described above, the refrigerant pipe 41, branching refrigerant pipes 11, 21, and 31, branching pipe 88*a*, vapor-liquid heat exchange unit 88*b* (motor-operated valves 81, 82, and 83), gas pipe thermistor, liquid pipe thermistor, and other internal components are disposed so as to be positioned in the insulation space 50S that has been sealed in a substantially airtight manner by the insulation material resin casing 51 and the expanded insulation material casing 54, as shown in FIG. 4.

Figure 7:
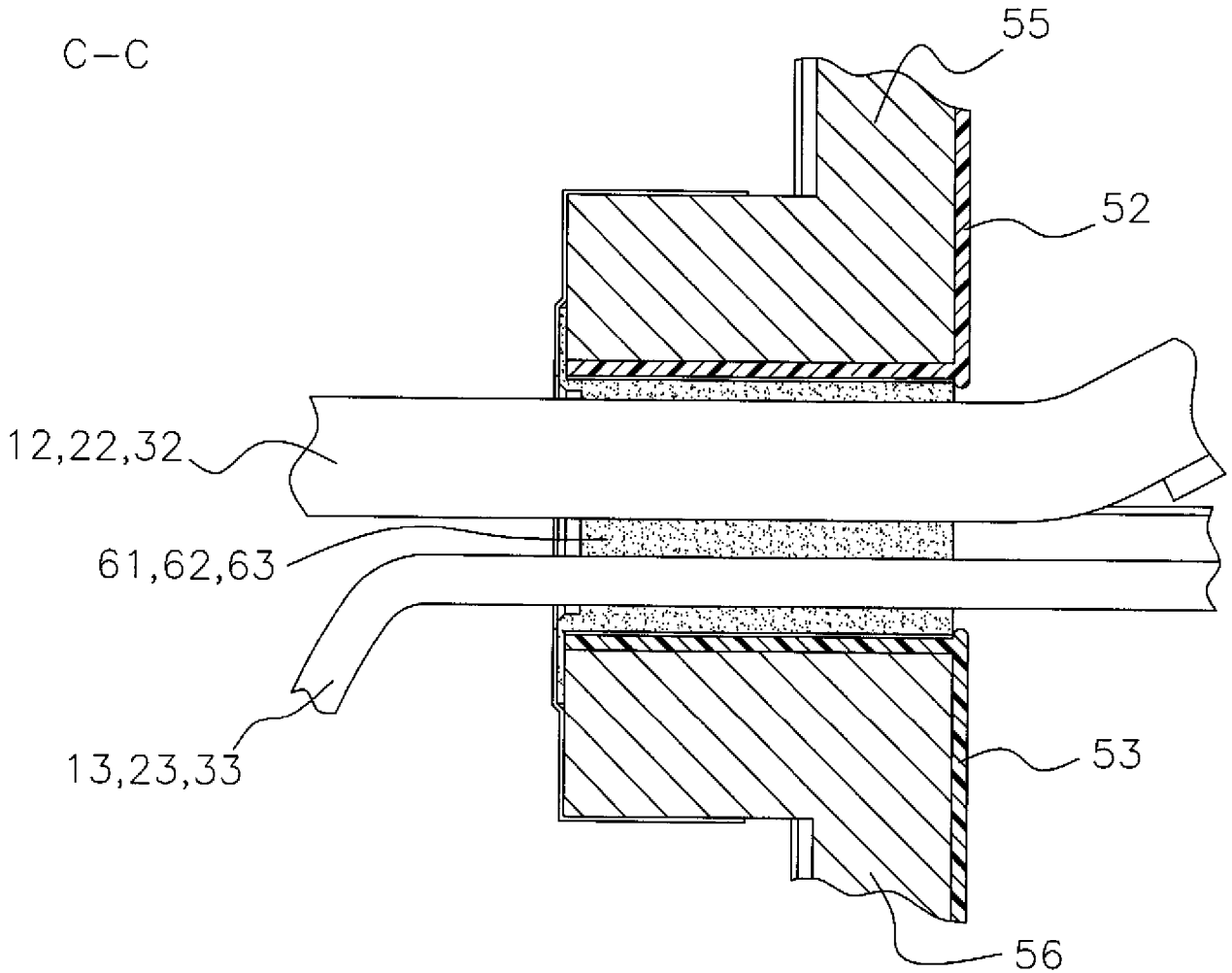
FIG. 7 is a cross-sectional view of the cross-section C-C of the branching unit.

FIG. 7 shows the cross section C-C in detail in FIG. 5.

The rubber bushings 61, 62, 63, and 64 enclose the liquid pipes 13, 23, 33, and 43 and the gas pipes 12, 22, 32, and 42 as a single body, as described above. The rubber bushings 61, 62, 63, and 64 are formed from rubber having low thermal conductivity, and are therefore capable of effectively preventing heat exchange between the liquid pipes 13, 23, 33, and 43 and the gas pipes 12, 22, 32, and 42.

The plate metal casing 57 is disposed so as to be in contact with the external periphery of the expanded insulation material casing 54, as shown in FIG. 4, and is composed of an upper plate metal casing 57*a* that is disposed so as to be in contact with the upper side of the upper insulation material casing 55, and a lower plate metal casing 57*b* that is disposed so as to be in contact with the lower side of the lower insulation material casing 56. The upper plate metal casing 57*a* and lower plate metal casing 57*b* are molded from a metal casing. The spread of fire from the motor-operated valves 81, 82, and 83 and other components in an emergency can thereby be effectively prevented. The upper plate metal casing 57*a* and lower plate metal casing 57*b* are fitted together in the vertical direction so as to enclose the insulation material resin casing 51 and the expanded insulation material casing 54 described above, and are threadably attached to each other by a screw (not shown). Force is applied so that the expanded insulation material casing 54 and insulation material resin casing 51 are pressed together in the vertical direction, and the airtightness of the insulation structure can be improved.

The upper plate metal casing 57*a* has a first side surface portion 58*a* positioned on the left side as viewed from the outdoor unit 40; a second side surface portion 58*b* positioned on the right side as viewed from the outdoor unit 40, i.e., on the side opposite from the first side surface portion 58*a*; a side surface 58*e* facing the outdoor unit; a side surface 58*d* facing the indoor unit; and an upper surface 58*e*. A first mounting hole 65 for mounting the electric component box 70 using a board mounting pawl 77 (described later) is provided to the first side surface portion 58*a*. A second mounting hole 66 is provided to the second side surface portion 58*b* in the same manner. The electric component box 70 is detachably mounted on the main body 50 using each of the mounting holes 65 and 66.

The pipe receiving portion 59 is composed of an outdoor unit-side pipe receiving portion 44, and indoor unit-side pipe receiving portions 14, 24, and 34, as shown in FIGS. 7 and 3. The outdoor unit-side pipe receiving portion 44 has a first receiving member 44*a* and a second receiving member 44*b*. The first receiving member 44*a* and second receiving member 44*b* are fitted from the left and right directions as viewed from the outdoor unit 40, whereby the refrigerant pipe 41 (gas pipe 42 and liquid pipe 43) is sandwiched therebetween. The indoor unit-side pipe receiving portion 14 (14*a* and 14*b*), the indoor unit-side pipe receiving portion 24 (24*a* and 24*b*), and the indoor unit-side pipe receiving portion 34 (34*a* and 34*b*) also have the same configuration as the outdoor unit-side pipe receiving portion 44 described above, and a description is omitted.

One side of the main body 50 is disposed in a state in which the gas pipe 42 and liquid pipe 43 on the side of the outdoor unit 40 are exposed from the outdoor unit-side pipe receiving portion 44, as shown in FIGS. 2 and 4. The other side of the main body 50 is disposed in a state in which the gas pipes 12, 22, and 32 and the liquid pipes 13, 23, and 33 of the indoor units 10, 20, and 30 side are exposed from the indoor unit-side pipe receiving portions 14, 24, and 34, as shown in FIGS. 2 and 4.

(Structure of the Electric Component Box 70)

The electric component box 70 is composed of a board 71, a board cover 72, a board mounting frame 73, and other components, as shown in FIG. 3.

The board 71 is connected by electric wires to electric components and the like housed in the main body 50. A CPU for controlling the apparatus, a ROM, a RAM, a power circuit, and other components are mounted on the board 71.

In this case, the electrical component box 70 is assembled by fitting the board cover 72 and board mounting frame 73 to each other. The board 71 is accommodated inside the electrical component box 70, and the board 71, board cover 72, and board mounting frame 73 form a single unit.

In this case, a board casing 74 is assembled by fitting the board cover 72 and board mounting frame 73 to each other. The board 71 is accommodated inside the board casing 74, and the board 71, board cover 72, and board mounting frame 73 form a single unit that serves as the electric component box 70.

The electric component box 70 is capable of being mounted on either the first side surface portion 58*a* or the second side surface portion 58*b* of the main body 50. Specifically, a board mounting pawl 77 is provided to the board mounting frame 73 of the electric component box 70. The electric component box 70 is mounted on the main body 50 by inserting and hanging the board mounting pawl 77 in the first mounting hole 65 of the first side surface portion 58*a* or the second mounting hole 66 of the second side surface portion 58*b*.

(Maintenance and Disassembly Work of the Branching Unit 5)

The plate metal casing 57, expanded insulation material casing 54, and insulation material resin casing 51 that are threadably attached to each other can easily be disassembled in the vertical direction by merely removing the screws in order to perform maintenance of the branching unit 5, e.g., replacement, repair, and other maintenance of the gas pipe thermistor, liquid pipe thermistor, motor-operated valves, and other internal components.

After maintenance has been completed, the insulation material resin casing 51 and expanded insulation material casing 54 are mounted using the same procedure described above, the plate metal casing 57 is attached, and the respective components are threadably attached.

<Characteristics of the Branching Unit 5 According to the Present Embodiment>

(1)

With the insulation structure used in a conventional branching unit, a refrigerant pipe and insulation material are disposed in close contact. For this reason, there are cases in which the refrigerant pipe and the insulation material adhere to each other, and disassembly work becomes laborious when maintenance or the like of the motor-operated valves and other components related to the refrigerant pipe is carried out. When a branching portion has a complex structure, the disassembly problem described above is made even more serious.

In contrast, with the branching unit 5 in the embodiment described above, the branching portion 88 and motor-operated valves 81, 82, and 83 are separated by an insulation space 50S and enclosed by an insulation material resin casing 51. For this reason, the branching portion 88 is not in direct contact with the insulation material resin casing 51 and expanded insulation material casing 54. The expanded insulation material casing 54 is disposed on the external periphery of the insulation material resin casing 51. The insulation properties of the branching portion 88 are thereby assured by the expanded insulation material casing 54 and the insulation space 50S maintained between the insulation material resin casing 51. For this reason, the insulation material resin casing 51 and expanded insulation material casing 54 can be prevented from adhering to the branching portion 88, and the branching portion 88, insulation material resin casing 51, and expanded insulation material casing 54 can easily be disassembled.

Therefore, the disassembly work of the branching unit 5 can be facilitated while assuring the insulation properties in the branching portion 88.

For example, condensation can be reduced and the work of disassembling the branching unit 5 can be facilitated while assuring the insulation properties by maintaining airtightness in the refrigerant circuit that includes the motor-operated valves 81, 82, and 83.

(2)

In the branching unit 5 in the embodiment described above, two structure units are used, i.e., the upper resin casing 52 and the upper insulation material casing 55 as one unit, and the lower resin casing 53 and the lower insulation material casing 56 as another unit. The two structural units can thereby be easily assembled and disassembled by merely separating or fitting the two together.

In the branching unit 5 of the embodiment described above, the two structural units have a structure in which the units are separated in a vertical manner with respect to the plane in which the branching refrigerant pipes 11, 21, and 31 are aligned. The assembly and disassembly of the branching unit 5 can therefore be further improved.

(3)

In the branching unit 5 in the embodiment described above, a mating portion 52*a* of the upper resin casing 52 has a concave shape (a pair of parallel grooves), and a mating portion 53*a* of the lower resin casing 53 has a convex shape (a pair of projections or lips). The mating portions 52*a* and 53*a* define a groove and projection structure configured such that the concave and convex shapes fit each other. The movement of the upper resin casing 52 and the lower resin casing 53 is limited in the direction perpendicular to the concavo-convex direction.

Therefore, the seal properties between the upper resin casing 52 and lower resin casing 53 can be improved by using the mating structure produced by the concave and convex shapes.

(4)

In the branching unit 5 in the embodiment described above, the branching portion 88 is limited so that the amount of generated heat is reduced. In addition, in this case, the fire can be effectively prevented from spreading in an unforeseen emergency because the plate metal casing 57 that covers the external periphery of the expanded insulation material casing 54 is made of metal.

The branching unit 5 has a structure that is covered by the plate metal casing 57, and the strength of the branching unit 5 can be improved overall even when the expanded insulation material casing 54 is a soft material.

(5)

In the branching unit 5 in the embodiment described above, a hard injection-molded resin is used as the material of the insulation material resin casing 51 disposed inside the branching unit 5. The seal properties between the upper resin casing 52 and lower resin casing 53 are therefore further effectively improved.

Since an injection-molded resin is used as the material of the insulation material resin casing 51, the resin can easily be molded so as to conform to a complex shape when the shape of the insulation material resin casing 51 is a complex shape.

(6)

A conventional insulation structure is constructed by causing urethane to expand. However, the method of causing urethane to expand has the following problems. In other words, since the temperature increases (about 100° C.) due to the foaming heat, there is a need such as to dispose or otherwise position functional components disposed in the vicinity of the branching portion, temperature sensors, and the like outside of the foaming space in order to be protected from the foaming heat.

In contrast, in the manufacturing process of the branching unit 5 of the embodiment described above, first, the branching portion 88 is enclosed in the insulation material resin casing 51 while assuring an insulation space 50S. Then, the insulation material resin casing 51 is enclosed using an expanded insulation material casing 54 in which EP, EPS, EPP, PP, or other material has been foamed and cooled in advance. In this case, the expanded insulation material casing 54 is shaped so as to follow the external periphery of the insulation material resin casing 51. The insulation material resin casing 51 and expanded insulation material casing 54 in this case may be integrally molded in advance. Then, the expanded insulation material casing 54 is enclosed by the plate metal casing 57.

In this manner, it is possible to solve the problem of the effect of foaming heat on temperature sensors and functional components that have a low resistance to heat and the like by manufacturing the branching unit 5 using an expanded insulation material casing 54 that has been molded and cooled in advance.

In accordance with the method of manufacturing of the embodiment described above in which an expanded insulation material casing 54 is used, the effect of expanded foam heat on the thermistor can be avoided and damage to the thermistor can be eliminated even when a thermistor having low resistance to heat is disposed in the vicinity of the motor-operated valves 81, 82, and 83 of the branching portion 88, for example.

Also, the cost of components can thereby be reduced because components with poor heat resistance can be used in the branching portion 88 of the branching unit 5.

The branching unit 5 can furthermore be manufactured without contact between the expanded insulation material casing 54 and the branching portion of the refrigerant pipe by manufacturing the branching refrigerant relay unit in accordance with the steps described above. For this reason, the insulation material can be prevented from adhering to the branching portion of the refrigerant pipe, and the branching portion 88, insulation material resin casing 51, and expanded insulation material casing 54 can be more easily disassembled.

When the branching portion 88 is enclosed by the insulation material resin casing 51, the branching portion 88 is preferably enclosed under low-humidity atmospheric conditions. Moisture and humidity in the enclosed insulation space SOS can thereby be reduced in advance, and the generation of condensation can be effectively reduced.

There are other problems in urethane foaming. The specific problems are that disassembly is not easy and productivity is poor because considerable curing time is required in the foaming step. There is also a problem in that costs are high because special foaming equipment and tools are required for urethane foaming. A further problem is that the structure must be one in which the urethane does not make contact with air because urethane reacts with moisture becomes carbonized. In contrast, in the branching unit 5 of the embodiment described above, these problems can be solved because an expanded insulation material casing 54 is used in which at least one material selected from PS, EPS, PP, and EPP is contained as the expanded insulation material casing 54.

(7)

In the branching unit 5 in the embodiment described above, the rubber bushings 61, 62, 63, and 64 are formed into a shape in which the external periphery thereof corresponds to the corresponding portions of the upper resin casing 52 and lower resin casing 53.

For this reason, the shape of the rubber bushings 61, 62, 63, and 64 can be stabilized in a constant shape. The seal properties between the rubber bushings 61, 62, 63, and 64 and the corresponding portions of the upper resin casing 52 and the lower resin casing 53 can be improved.

In addition, the rubber bushings 61, 62, 63, and 64 are molded using a material that contains rubber, and have elasticity in the direction enclosed by the corresponding portions of the upper resin casing 52 and lower resin casing 53.

The synergistic effect between the elasticity and the stability of the shape of the rubber bushings 61, 62, 63, and 64 further improves the seal properties between the corresponding portions of the rubber bushings 61, 62, 63, and 64, and the upper resin casing 52 and lower resin casing 53.

Moreover, the rubber bushings 61, 62, 63, and 64 are formed from rubber having low thermal conductivity, and are therefore capable of effectively preventing heat exchange between the liquid pipes 13, 23, 33, and 43 and the gas pipes 12, 22, 32, and 42.

<Another Embodiment>

In the branching unit 5 of the embodiment described above, an example was described in which the seal properties are improved by using a mating structure in which the mating portion 52*a* of the upper resin casing 52 has a concave shape and the mating portion 53*a* of the lower resin casing 53 has a convex shape.

However, the present invention is not limited to this configuration, and the mating structure described above may be one in which, for example, the mating portion of the upper resin casing 52 and the part of the upper insulation material casing 55 that corresponds to the mating portion have a concave shape, and the mating portion of the lower resin casing 53 and part of the lower insulation material casing 56 that corresponds to the mating portion have a convex shape that fits into the concave shape. In this case, the movement of the upper resin casing 52 and upper insulation material casing 55, and the lower resin casing 53 and lower insulation material casing 56 is restricted in the direction perpendicular to the concavo-convex direction. Therefore, the mating structure produced by the concave and convex shapes can improve the seal properties between the upper resin casing 52 and upper insulation material casing 55, and the lower resin casing 53 and lower insulation material casing 56.

INDUSTRIAL APPLICABILITY

The branching unit according to the present invention can facilitate disassembly work, and is therefore particularly useful in a branching unit and a manufacturing method thereof in which a refrigerant pipe is branched into a plurality of branching refrigerant pipes.

The invention claimed is:

1. A branching refrigerant relay unit in which a refrigerant pipe has a branching portion that couples to a plurality of branching refrigerant pipes, the branching refrigerant relay unit comprising:

an insulation material configured to enclose the branching portion;

a partition member disposed between the insulation material and the branching portion, the partition member separating the insulation material from the branching portion while assuring space between the partition member and the branching portion; and a casing for covering the external periphery of at least a portion of said insulation material, said partition member having a first partition portion and a second partition portion configured as a pair including respective mating portions for mating with one another, said casing having a first casing portion and a second casing portion configured as a pair including respective mating portions for mating with one another, and said insulation material having a first insulation material configured to be integral with said first casing portion and said first partition portion, and a second insulation material configured to be integral with said second casing portion and said second partition portion.

2. The branching refrigerant relay unit as recited in claim 1, wherein said mating portion of said first casing is a concave shape, and said mating portion of said second casing is a convex shape configured to mate with said concave shape.

3. The branching refrigerant relay unit as recited in claim 1, wherein said casing is made of metal.

4. The branching refrigerant relay unit as recited in claim 1, wherein said partition member contains an injection-molded resin.

5. The branching refrigerant relay unit as recited in claim 1, wherein said insulation material contains at least one material selected from PS, EPS, PP, and EPP.

6. The branching refrigerant relay unit as recited in claim 1, wherein said partition member has a through portion for allowing a pipe that extends from the branching portion to pass through, and a surrounding portion that surrounds said through portion from a direction perpendicular to a through direction; and said through portion contains rubber and the external periphery thereof is molded so as to have a shape that corresponds to said surrounding portion.

7. The branching refrigerant relay unit as recited in claim 2, wherein said concave shape includes at least one groove, and said convex shape includes at least one projection configured to mate with said groove.

8. A method of manufacturing the branching refrigerant relay unit as recited in claim 1, the method of manufacturing the branching refrigerant relay unit comprising:

forming the partition member so as to enclose the branching portion of the refrigerant pipe while assuring space between the partition member and the branching portion;

enclosing the partition member using the insulation material molded in advance so as to follow the external periphery of the partition member; and enclosing the insulation material using the casing, the casing being formed of metal.

9. The method of manufacturing a branching refrigerant relay unit as set forth in claim 8, wherein:

said casing is formed by forming the first casing portion with the concave shape along an edge thereof and forming the second casing portion with the convex shape on an edge thereof such that the concave shape and the convex shape mate with one another.

* * * * *